US006314782B1

(12) United States Patent
Stahl et al.

(10) Patent No.: US 6,314,782 B1
(45) Date of Patent: Nov. 13, 2001

(54) ROLL STAND WITH MULTIPLE ROLLS

(75) Inventors: Werner Stahl, Kreuztal; Axel Barten, Siegen, both of (DE)

(73) Assignee: Achenbach Buschhütten GmbH, Kreuztal (DE)

( * ) Notice: Subject to any disclaimer, the term of this patent is extended or adjusted under 35 U.S.C. 154(b) by 0 days.

(21) Appl. No.: 09/631,232

(22) Filed: Aug. 2, 2000

(30) Foreign Application Priority Data

Aug. 3, 1999 (DE) ..... 199 36 427

(51) Int. Cl.[7] ..... B21B 13/14
(52) U.S. Cl. ..... 72/241.8; 72/242.2; 72/247
(58) Field of Search ..... 72/241.8, 241.2, 72/247, 242.2, 242.4, 243.2, 243.4, 243.6, 240

(56) References Cited

U.S. PATENT DOCUMENTS

| | | | | |
|---|---|---|---|---|
| 1,776,436 | * | 9/1930 | Iversen | 72/241.8 |
| 4,162,627 | * | 7/1979 | Shida et al. | 72/247 |
| 4,848,128 | * | 7/1989 | Bohnenkamp et al. | 72/247 |

FOREIGN PATENT DOCUMENTS

| | | | | |
|---|---|---|---|---|
| 2206912 | | 4/1984 | (DE) . | |
| 195 18 144 A1 | | 11/1995 | (DE) . | |
| 0121811 | | 3/1987 | (EP) . | |
| 0665067 | | 8/1995 | (EP) . | |
| 63-230204 | * | 9/1988 | (JP) | 72/242.2 |
| 10 263 632 A | | 10/1998 | (JP) . | |

OTHER PUBLICATIONS

"Kostengünstiges Verfahren. Durch Flexibles Walzen Belastungsgerecht Erzeugte Blechdickenprofile", 1995, vol. 23, Issue 10, PP 40–42.

Patent Abstracts of Japan, vol. 7, No. 1 (M–222), Jun. 15, 1983 & JP 58 53309 A (Mitsubishi Jukogyo K.K.) Mar. 29, 1983.

* cited by examiner

*Primary Examiner*—Lowell A. Larson
(74) *Attorney, Agent, or Firm*—Friedrich Kueffner

(57) ABSTRACT

A roll stand with multiple rolls for rolling strip-shaped rolling stock has a roll frame and upper and lower working rolls mounted on the roll frame in a common vertical roll axis plane, wherein the rolling stock is guided between the upper and lower working rolls forming a roll set. Upper and lower support roll insert parts are mounted on the roll frame. Two upper support rolls are mounted in the upper support roll insert parts and support the upper working roll, and two lower support rolls are mounted in the lower support roll insert parts and support the lower working roll. The two upper and the two lower support rolls are arranged symmetrically to the vertical roll axis plane, respectively. Working roll bending devices are mounted on the roll frame and act on the upper and lower working rolls. Balancing devices are mounted on the roll frame and advance and balance the upper and lower support rolls. The two upper and two lower support rolls are axially moveable independently from one another relative to a vertical center plane of the roll frame, extending perpendicularly to the vertical roll axis plane, by same or different axial displacement lengths in order to compensate roll set bending of the roll set and to provide adjustment to a width of the roll stock for flexible rolling via the working rolls.

11 Claims, 4 Drawing Sheets

ROLL STAND WITH MULTIPLE ROLLS

BACKGROUND OF THE INVENTION

1. Field of the Invention

The invention relates to roll stands with multiple rolls for rolling strip-shaped roll stock, comprising a lower working roll and an upper working roll, support rolls correlated with each working roll, roll bending devices for the working rolls, as well as devices for advancing and balancing the support rolls, wherein the lower and the upper working rolls of the roll stand are supported in two lower, respectively, two upper support rolls which are arranged symmetrically to the vertical roll axis plane of the working rolls and are supported in pairs in lower and upper support roll insert parts.

2. Description of the Related Art

A roll stand with multiple rolls of this kind is known from JP 10 263 632 A.

The on-going improvement of environmental conditions, the scarcity of raw materials, and the requirement asked of the industry to produce components of different kinds with optimal, product-specific properties in a cost-effective manner, have resulted in the development of new manufacturing methods to which belongs the so-called "flexible rolling". Flexible rolling, in which the roll gap during the rolling process if controlled according to the thickness profile of a strip of roll stock changing over the strip length, makes a processing time-reducing manufacture of strip material possible whose thickness profile changes in the rolling direction as calculated, relating to a certain component and matched to the load situation. Such rolled strip manufactured of steel and non-iron metals is suitable for the lightweight construction in the automobile industry, air and space technology, and railroad car construction (DE-Z Fertigung, 1995, volume 23, issue 10, pp. 40–42).

While in conventional rolling it is desired to produce a flat strip that is as planar as possible and without profile changes along the entire strip length, in the flexible rolling process it is desired to produce controlled strip thickness changes over the strip length. The possible strip thickness reduction can be performed in a controlled fashion between a minimal reduction, which still maintains a stable rolling process, and a maximum reduction of more than 50%.

DE 195 18 144 A1 describes a rolling mill with working rolls which inherently carry the risk of horizontal bending during the rolling process because of their small roll diameter. In this rolling mill, the upper and the lower working rolls are driven, respectively, by a circumferential force, generated by the rolling force, of the rolling moments introduced into the support rolls. In a further multi-roll stand described also in DE 195 18 144 A1 the working rolls are supported by support roll pairs. The working rolls, which are accordingly guided along two contact lines relative to the support rolls, allow only a limited adjusting range for the working roll bending.

DE 22 06 912 C3 discloses a roll stand with two working rolls and oppositely displaceable intermediate rolls which can be adjusted to the width of the strip. They are respectively rotationally positioned in a support roll pair wherein the working rolls are provided with a roll bending device for improved adaptation to the strip profile. A disadvantage of this roll stand type for the application in flexible rolling is also the horizontal bending of the working rolls, the circumferential force transmitting the rolling moment, as well as the relatively large masses with respect to the required high acceleration properties of the roll advancement.

A further type of working roll support against horizontal bending by means of laterally arranged support rolls is described in EP 0 121 811 B1. However, this rolling mill concept without drive of the working rolls also does not provide an improvement of the rolling moments introduced into the working rolls.

Roll stands with multiple rolls according to EP 0 665 067 B1 comprise working rolls with smallest diameters and sufficient support, but require a considerable expenditure with respect to features for compensation of the bending of the roll set, such as support rolls and bending devices, and are limited with respect to the obtainable strip thickness reduction.

The positional changes required for flexible rolling in order to follow at all times the set-point strip length profile changes and the thus needed rolling force and rolling moment changes require a high dynamics of the roll advancement and the roll drive. On the one hand, a safe and no-slip transmission of the rolling moments onto the working rolls must be ensured; on the other hand, the accelerated controlled opening and closing of the rolling gap changes the pressing force between the support rolls and working roll. Moreover, the rolling force constantly changing during a reduction stage as a function of the thickness reduction results in a dynamic bending of the roll set.

SUMMARY OF THE INVENTION

It is an object of the present invention to develop a roll stand for flexible rolling of strip-shaped roll stock.

In accordance with the present invention, this is achieved in that, for flexible rolling of strip-shaped roll stock, the four support rolls can be displaced relative to the vertical central plane of the roll stand independently of one another in the axial direction by the same or different displacement lengths for the purpose of compensating the occurring roll set bending. and for adaptation to the roll stock width.

According to a preferred embodiment, the support rolls are supported in bearing units which are arranged in the support roll insert parts so as to be slidable in the axial direction of the support rolls.

Preferably, the pressure of the working roll bending devices actuated by a pressure medium is adjustable between a lower pressure value for balancing the working rolls and for a slip-preventing pressing thereof against the support rolls and an upper pressure value acting as a positive bending force.

Advantageously, a control of the working roll bending devices as a function of the rolling force is provided.

In another embodiment of the invention, a control of the working roll bending devices as a function of the roll stock width is provided.

Also, a control of the working roll bending devices as a function of the axial displacement position of the support rolls can be provided.

In a preferred embodiment of the invention, the balancing devices for the support rolls have adjusting cylinders acting on the support roll insert parts and having storage units for a continuous change of the advancing position of the support rolls.

Preferably, drive motors for the support rolls are provided which are arranged on the support roll insert parts and/or the bearing units.

DESCRIPTION OF THE PREFERRED EMBODIMENTS

Figure 1:
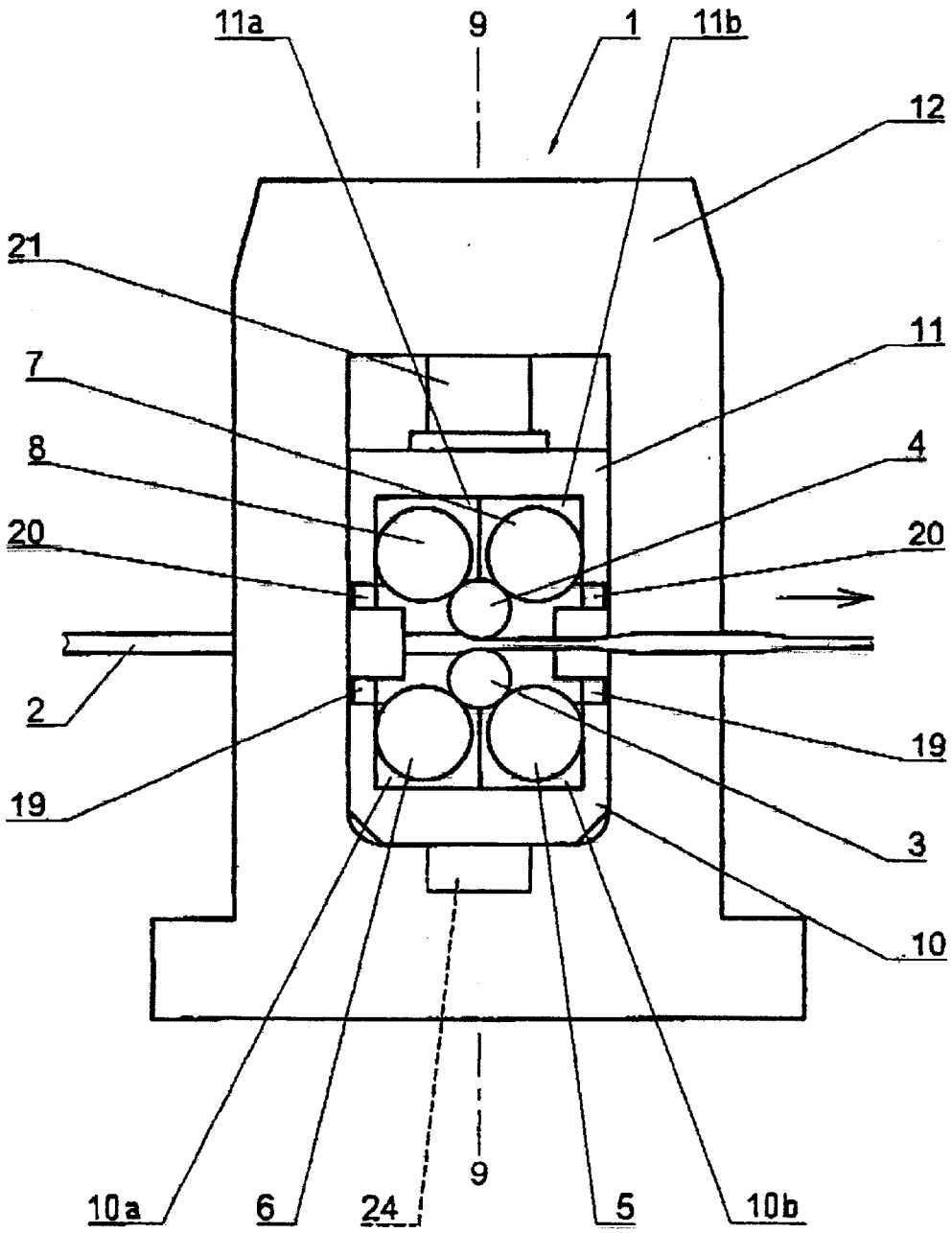
FIG. 1 is a side view of the roll stand according to the invention.
Figure 2:
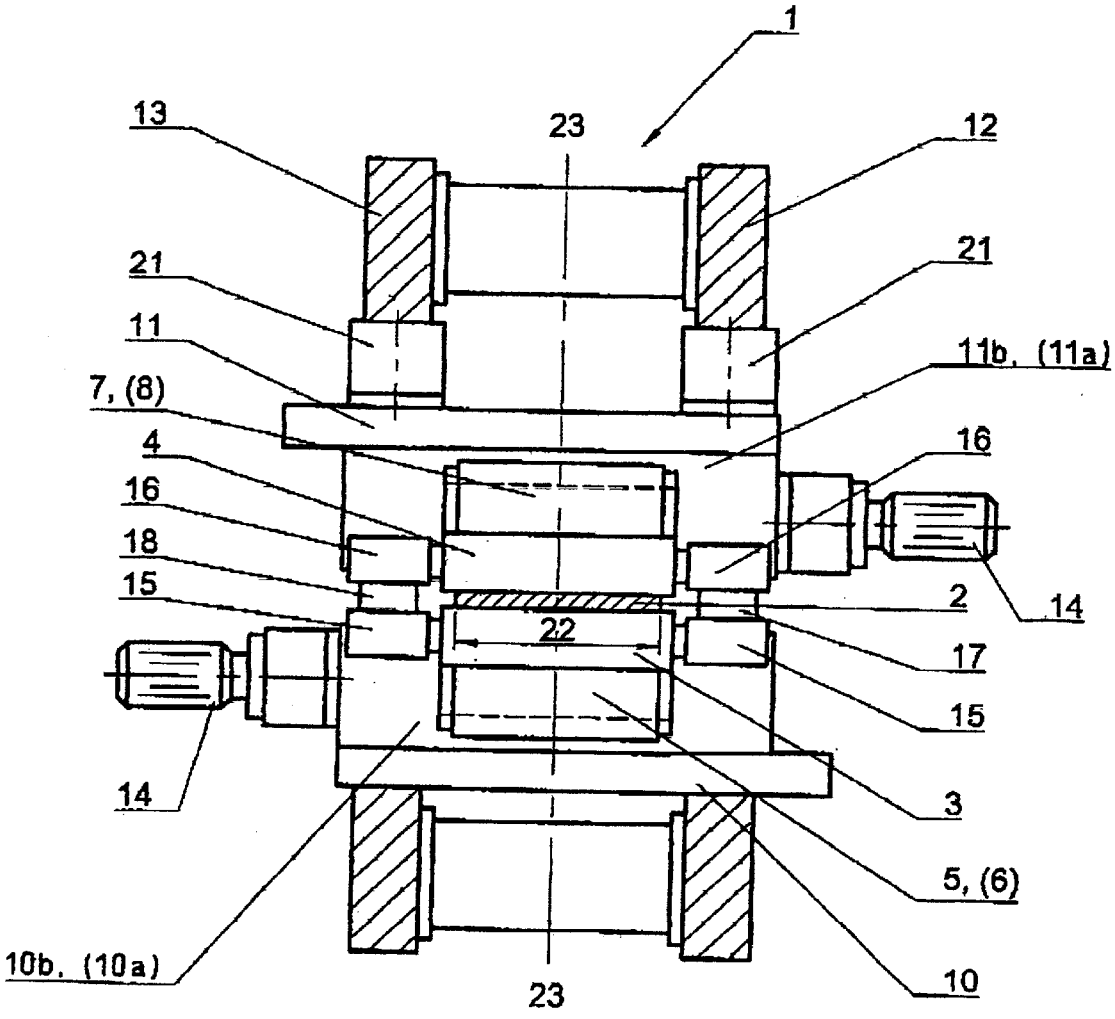
FIG. 2 is a front view of the roll stand of FIG. 1 with working rolls and support rolls symmetrically arranged relative to the vertical center plane of the roll stand.
Figure 3:
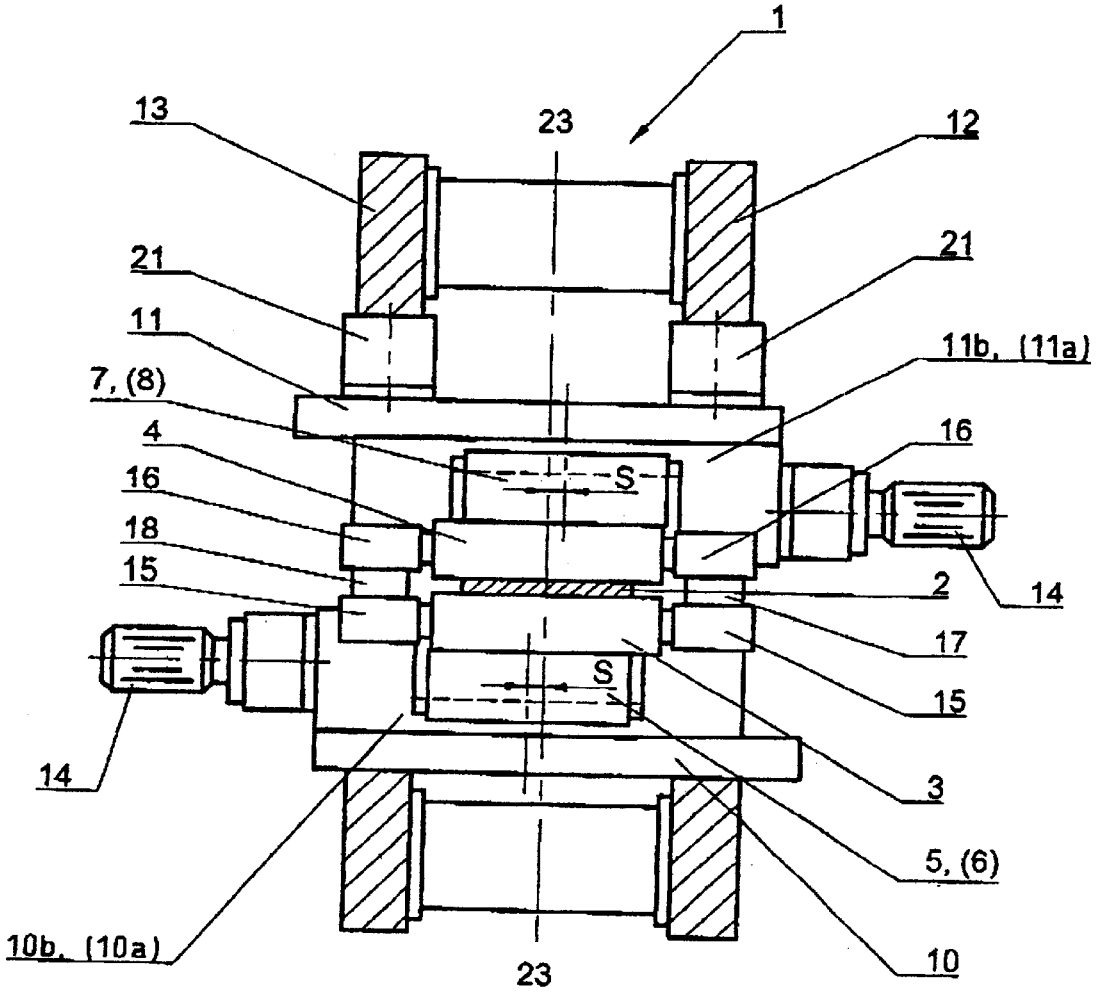
FIG. 3 is a front view of the roll stand of FIG. 1 showing the support rolls axially displaced in opposite directions relative to the working rolls.

The roll stand 1 according to FIGS. 1 through 3 for flexible rolling of strip-shaped roll stock 2 comprises an upper working roll 4 and a lower working roll 3, which, for avoiding a horizontal bending, are supported in two lower or two upper support rolls 5, 6; 7, 8, respectively. These support rolls 5, 6; 7, 8 are arranged symmetrically to the vertical roll axis plane 9-9 of the working rolls 3, 4 and are displaceably supported in the axial direction in bearing units 10*a*, 10*b*, 11*a*, 11*b* in the lower and the upper support roll insert parts 10, 11. These insert parts 10, 11 are vertically and horizontally moveably guided in the two roll frame parts 12, 13 of the roll frame of the roll stand 1.

The support rolls 5, 6; 7, 8 are driven by motors 14 mounted on the support roll insert parts 10, 11.

The lower and upper working rolls 3, 4 are supported in lower and upper working roll insert parts 15, 16 which are vertically slidably guided in the two roll frame parts 12, 13 and can be loaded by working roll bending devices 17, 18.

Balancing of the support rolls 5, 6; 7, 8 is realized by the balancing devices 19, 20 acting onto the lower and the upper support roll insert parts 10, 11.

Below the lower support roll insert parts 10, regulating devices 24 for adjusting the pass line of the rolling stand 1 are mounted in the two roll stands 12, 13.

The rolling force F introduced into the upper working roll 4 by means of the upper support rolls 7, 8 is generated by the roll advancing devices 21 mounted in the two roll frame parts 12, 13 and acting on the upper support roll insert part 11.

Figure 4:
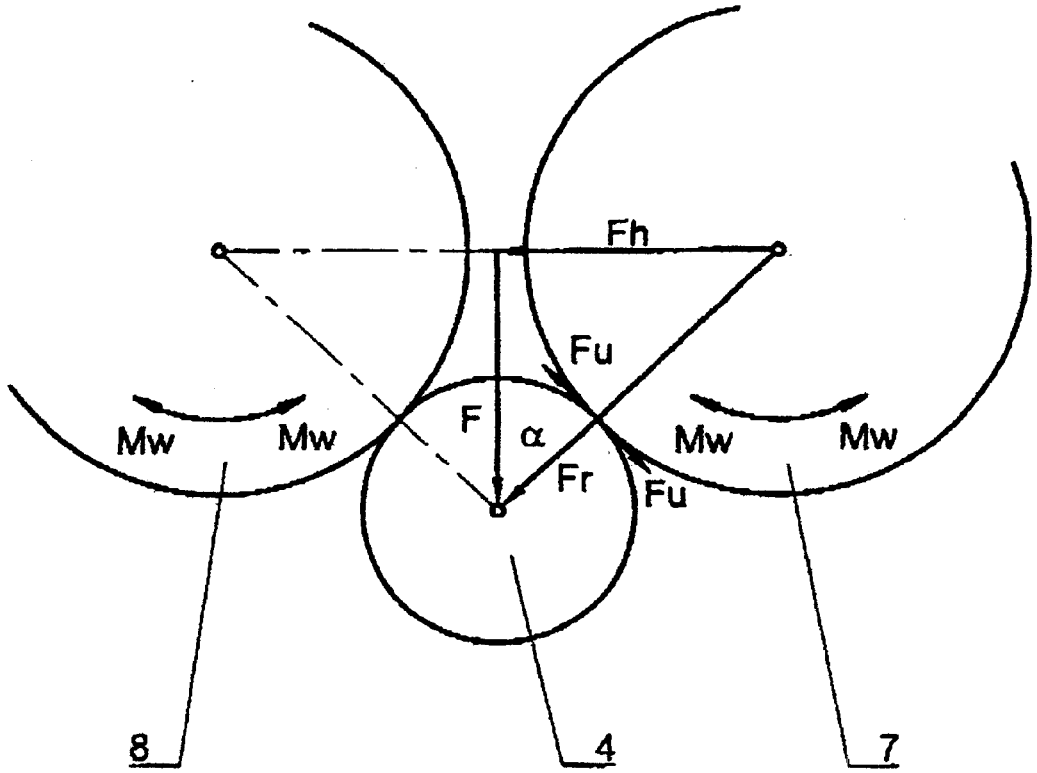
FIG. 4 illustrates the dynamics of the drive of the working roll by means of two support rolls.

The roll force F acting onto the upper support roll pair 7, 8 makes it possible to provide an introduction of the rolling moment $M_w$ into the upper working roll 4 that is improved by a factor $1/\cos\alpha$ based on a resolution of forces in a horizontal component $F_h$ of the rolling force F and a radial component $F_r$ of the rolling force F when employing the same frictional value between the upper support roll 7 or 8 and the upper working roll 4, wherein the rolling moment $M_w$ is determined by the component $F_u$ of the rolling force F acting in the circumferential direction of the support rolls 7, 8 and the working roll 4 (FIG. 4).

The working roll bending devices 17, 18 actuated by a pressure medium operate between a low slip-preventing pressing pressure, ensuring the contact between the support rolls 5, 6; 7, 8 and the working rolls 3,4 and ensuring at the same time a permanent balancing of the working rolls 3, 4, and a maximum pressure which acts as a positive bending force.

The control of the working roll bending devices 17, 18 is performed as a function of the rolling force F, of the width 22 of the roll stock, and the axial displacement position of the support rolls 5, 6, 7, 8.

The balancing devices 19, 20 for the support rolls 5, 6, 7, 8 comprise advancing cylinders acting on the support roll insert parts 10, 11 and having storage units for a continuous change of the advancing position of the support rolls 5, 6, 7, 8.

The four support rolls 5, 6, 7, 8 are axially movable by the same or different displacement lengths S in opposite directions and independently from one another relative to the vertical center plane 23-23 of the roll stand 1 for compensating the occurring roll set bending and for adaptation to the width 22 of the roll stock material 2.

While specific embodiments of the invention have been shown and described in detail to illustrate the inventive principles, it will be understood that the invention may be embodied otherwise without departing from such principles.

What is claimed is:

1. A roll stand with multiple rolls for rolling strip-shaped rolling stock, the roll stand comprising:

a roll frame;

an upper working roll and a lower working roll mounted on the roll frame in a common vertical roll axis plane, wherein the strip-shaped rolling stock is guided between the upper and lower working rolls forming a roll set;

upper support roll insert parts and lower support roll insert parts mounted on the roll frame;

two upper support rolls mounted in the upper support roll insert parts and configured to support the upper working roll, and two lower support rolls mounted in the lower support roll insert parts and configured to support the lower working roll;

the two upper support rolls and the two lower support rolls arranged symmetrically to the vertical roll axis plane, respectively;

working roll bending devices mounted on the roll frame and configured to act on the upper and lower working rolls;

balancing devices mounted on the roll frame and configured to advance and balance the upper and lower support rolls;

the two upper and two lower support rolls configured to be axially moveable independently from one another in a common direction or in opposite directions relative to a vertical center plane of the roll frame, extending perpendicularly to the vertical roll axis plane, by a same or a different axial displacement length in order to compensate roll set bending of the roll set of the working rolls and to provide adjustment to a width of the roll stock for the purpose of flexible rolling via the working rolls.

2. The roll stand according to claim 1, comprising bearing units mounted in the support roll insert parts, wherein the upper and lower support rolls are slidably arranged in the bearing units.

3. The roll stand according to claim 1, wherein the working roll bending devices are configured to be operated by a pressure medium and are further configured to apply a pressure onto the working rolls adjustable between a lower pressure value for balancing the working rolls and for a slip-preventing pressing of the working rolls against the upper and lower support rolls and an upper pressure value providing a positive bending force on the working rolls.

4. The roll stand according to claim 1, wherein the working roll bending devices are configured to be controlled based on a rolling force of the roll stand.

5. The roll stand according to claim 1, wherein the working roll bending devices are configured to be controlled based on a width of the roll stock.

6. The roll stand according to claim 1, wherein the working roll bending devices are configured to be controlled based on a position of the axial displacement of the upper and lower support rolls.

7. The roll stand according to claim 1, wherein the balancing devices comprise adjusting cylinders configured to act on the support roll insert parts, the adjusting cylinders having storage units for a continuous change of an advancing position of the support rolls.

8. The roll stand according to claim 1, further comprising drive motors configured to advance the support rolls.

9. The roll stand according to claim 8, wherein the drive motors are mounted on the support roll insert parts.

10. The roll stand according to claim 8, wherein the drive motors are mounted on the support roll insert parts and the bearing units.

11. The roll stand according to claim 8, wherein the drive motors are mounted on the bearing units.

* * * * *